United States Patent [19]

Hesser

[11] 4,253,401

[45] Mar. 3, 1981

[54] SUPPORTING MEANS FOR A WATER TANK FOR A RAILWAY CAR

[75] Inventor: Kenneth R. Hesser, Philadelphia, Pa.

[73] Assignee: The Budd Company, Troy, Mich.

[21] Appl. No.: 954,477

[22] Filed: Oct. 25, 1978

[51] Int. Cl.[3] ..... B61D 5/00; B61D 35/00

[52] U.S. Cl. ..... 105/329 R; 52/168; 105/238 R; 105/315; 248/318

[58] Field of Search ..... 105/327, 329 R, 314, 105/1 A, 315, 238 R; 248/318; 52/168, 192, 45

[56] References Cited

U.S. PATENT DOCUMENTS

| | | | |
|---|---|---|---|
| 2,410,173 | 10/1946 | Lutherman et al. | 105/315 |
| 3,687,087 | 8/1972 | Yurkoski et al. | 105/358 |
| 3,875,869 | 4/1975 | Molnar | 105/314 |

*Primary Examiner*—Richard A. Bertsch

*Attorney, Agent, or Firm*—A. L. Trueax, Jr.

[57] ABSTRACT

Support means for a plastic tank in a railway car includes a pair of side members suspended from the roof of a railway car. Base members for holding the tank are connected to the side members. Means are provided on the base member to restrain the lateral and longitudinal movement of the tank. Flexible means are provided to accommodate small movements and dimensional changes in the tank resulting from temperature changes.

9 Claims, 6 Drawing Figures

FIG. 1
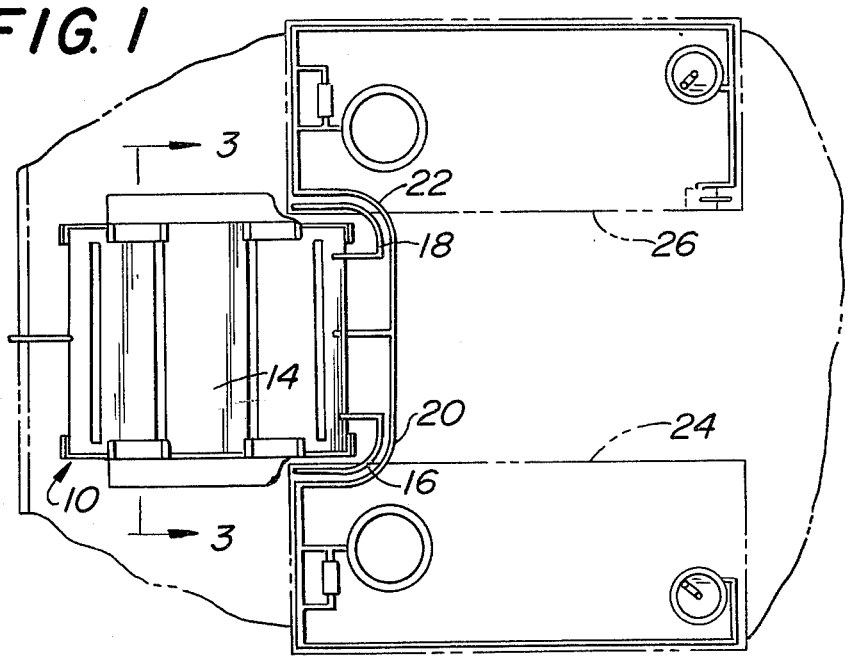
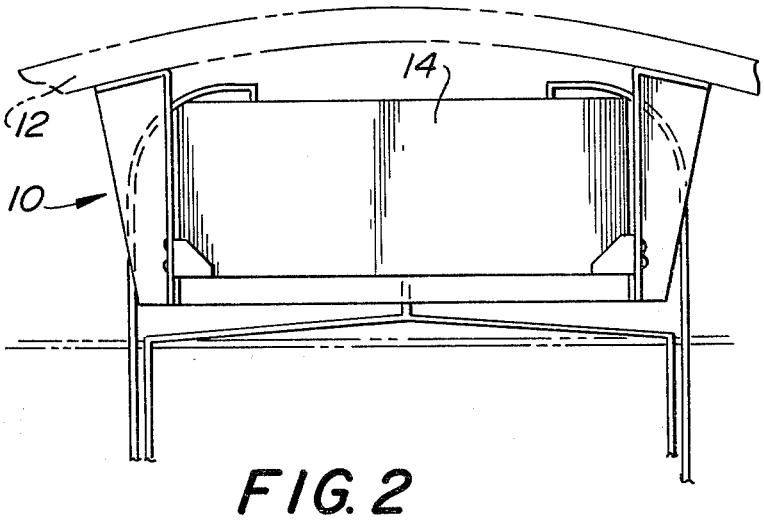
FIG. 2

SUPPORTING MEANS FOR A WATER TANK FOR A RAILWAY CAR

Heretofore water tanks in railway cars have been suspended from the roof. The water in the tank has been used to supply drinking water and for the bathroom facilities. In the main, metal water tanks have been used.

An important consideration in the design of a water tank system in a railway car is that it be maintained stable when subjected to large longitudinal forces such as those involved in sudden stopping of the car, for example. To prevent the tank from moving longitudinally, the stops for the metal tanks used heretofore have been welded to the support means.

Among the disadvantages of the use of a metal water tank in a railway car are the weight. Also, the metal tank tends to maintain its same dimensions when subjected to extreme temperature changes, which could range from a maximum temperature of 180° F. to a minimum of −40° F. When the water in the tank freezes and causes increased pressure in the tank, the tank and weld connections tend to crack and produce other problems.

To overcome the problems of weight and pressure changes within the tank resulting from temperature changes, plastic water tanks have been used in some recently built railway cars. However, because welding cannot be used to secure the tank firmly in place, strap arrangements have been used to hold the plastic tank. These straps have been suspended from the ceiling and designed to go around and hold the tank in position. While this arrangement has been satisfactory in many respects, it is desirable to have a more rigid support for the tank especially when the tank is subjected to abrupt longitudinal forces encountered when the car is stopped suddenly. The falling of such a tank could lead to serious personal injury.

The design of a plastic water tank generally results in a structure which is somewhat weaker than a metal tank. Consequently the support means for such plastic tanks must compensate wherever possible for the longitudinal and other external forces which would tend to build up and damage the tanks. For example, rib portions may be built in the plastic water tanks for increased strength. Unless properly supported, the tanks would tend to break at these portions when high forces are applied thereto.

It is an object of this invention to provide an improved support for a water tank in a railway car.

It is a further object of this invention to provide an improved support for a plastic water tank in a railway car.

It is still a further object of this invention to provide an improved support for a plastic tank in a railway car which prevents the tank from moving longitudinally when subject to sudden decelerations of the car.

It is still a further object of this invention to provide support for a plastic water tank built with strenthening ribs.

It is still a further object of this invention to provide an improved support for a plastic water tank which accommodates small expansion and contractions of the tank caused by freezing of the water in the tank.

In accordance with the present invention a support means for a plastic water tank having reinforcing rib portions is suspended from the roof of a railway car. The support means includes a pair of end angle brackets which may be connected to the roof carlines of the car. A base assembly includes a pair of angle bars having perpendicular sections to receive the ends of the water tank. Each of the angle bars terminate in front and rear portions extending from the perpendicular portions. The tank is disposed to fit into the base assembly with the angle bars including the front and rear portions disposed to limit lateral and longitudinal movement of the water tank in the support means. Strips are disposed within the rib portions of the tank and rest on the angle bars. Flexible cushion members are disposed between the top of the tank and the roof to accommodate small movements and dimensional changes in the tank resulting from temperature changes.

Other objects and advantages of the present invention will be apparent and suggest themselves to those skilled in the art, from a reading of the following specification and claims, taken in conjunction with the accompanying drawings, in which:

FIG. 1 is a top view of a water tank installed in a typical railway car, in accordance with the present invention;

FIG. 2 is a front view of the tank and connections thereto illustrated without the facilities illustrated in FIG. 1;

Figure 3:
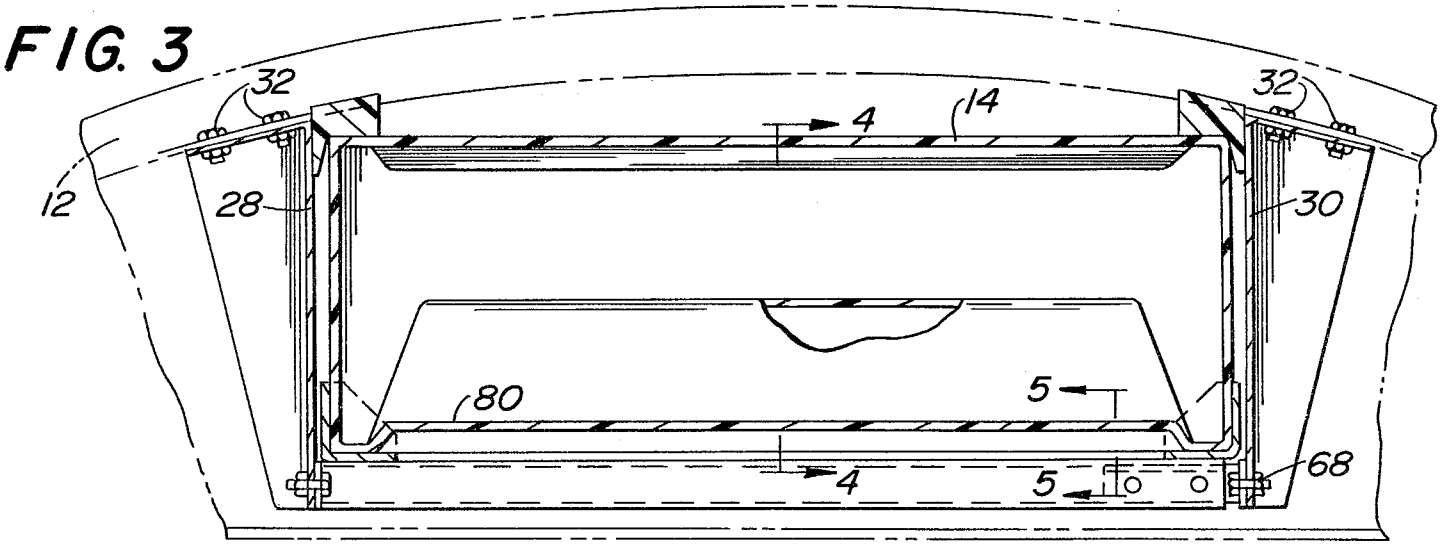
FIG. 3 is a cross-sectional view taken along lines 3—3 of FIG. 1.

Referring to FIGS. 1 and 2, support means 10 is suspended from the roof 12 of a railway car to support a water tank 14. The mounting is illustrated as connected to the carlines of the car. However the mounting may be to any relatively high structure within the car, preferably above the ceiling to permit the water in the tank to be gravity fed to the facilities below within the car.

Water is supplied to the tank 14 from a suitable source, which may include a pump, through inlets 16 and 18. Outlets 20 and 22 supply the water from inside the water tank to bathroom facilities 24 and 26. These facilities may include the water closet, sink and drinking water fountain found in conventional cars. The various connections, valves and other items normally associated with such facilities are not illustrated and will not be discussed further because they are only incidentally related to the present invention.

Figures 5, 6:
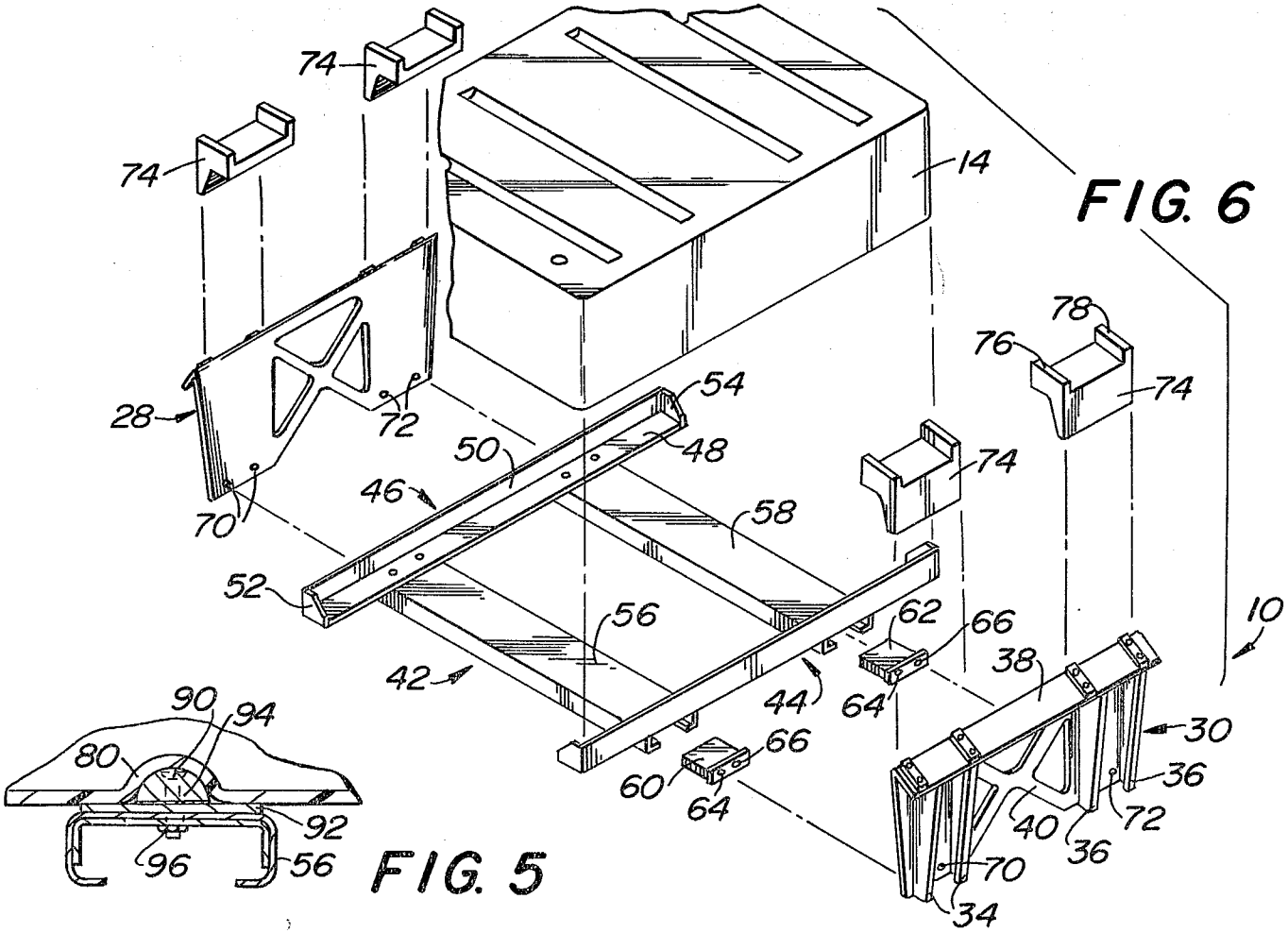
FIG. 5 is a view taken along lines 5—5 of FIG. 3.
FIG. 6 is an exploded view of the support means, in accordance with the present invention.

Referring to FIGS. 3 and 5, along with the other figures, a pair of end brackets 28 and 30 are mounted to a carline on the roof 12 by means of suitable bolts 32. Both brackets are the same and, therefore, only the bracket 30 will be described. Each of the end brackets 28 and 30 include pairs of reinforced front and rear portions 34 and 36 and a top flat portion 38 disposed at an angle corresponding to the slope of the roof. The flat portions 38 are bolted to the roof 12 by means fo the bolts 32. A cut-out cross brace portion 40 connects the rear and front portions 34 and 36. The cut-away provides strength while minimizing weight and use of material.

A bottom assembly 42 includes a pair of angular members 44 and 46. Because both of the members 44 and 46 are identical, only the member 46 will be described. The member 46 includes a flat horizontal portion 48 perpendicular to a vertical portion 50. Front and rear portions 52 and 54 connect the ends of the portions 48 and 50.

The angular members 44 and 46 are connected by a pair of cross support channels 56 and 58 by welding or other suitable connecting means. The ends of the channels 56 and 58 are dimensioned to receive plates 60 and 62 therein. The plates 60 and 62 include openings 64 and 66 to receive connecting pins 68 or bolts which extend through openings 70 and 72 in the end brackets 28 and 30.

During installation of the water tank 14, the end brackets 28 and 30 are first bolted to the carlines of the roof 12 by means of bolts 32. The water tank 14 is then placed on the bottom assembly 42. The dimensions and spacing of the angular members 44 and 46 are such that the water tank 14 fits on the flat horizontal portions 48 precisely between the vertical portions 50. This arrangement prevents the water tank 14 from moving laterally on the bottom assembly after installation. The front and rear portions 52 and 54 are spaced to receive the water tank 14 precisely therebetween. These portions prevent the water tank 14 from being moved longitudinally after installation when the railway car is subjected to sudden deceleration.

Restrainer elements 74 include projections 76 and 78 which are fitted into depressions of openings in the carlines of the roof 12. The restrainer elements are resilient and may comprise molded vulcanized pieces. These members are installed prior to the positioning of the water tank 14 between the end brackets 28 and 30.

When the water tank 14 is positioned on the bottom assembly 42 and the end brackets 28 and 30 are in place on the roof, the bottom assembly 42 is lifted along with the tank 14 between the end brackets 28 and 30. The plates 60 and 62, which are secured within the ends of the channels 56 and 58 are then connected to the end brackets by means of pins or bolts 68 or other suitable means.

Figure 4:
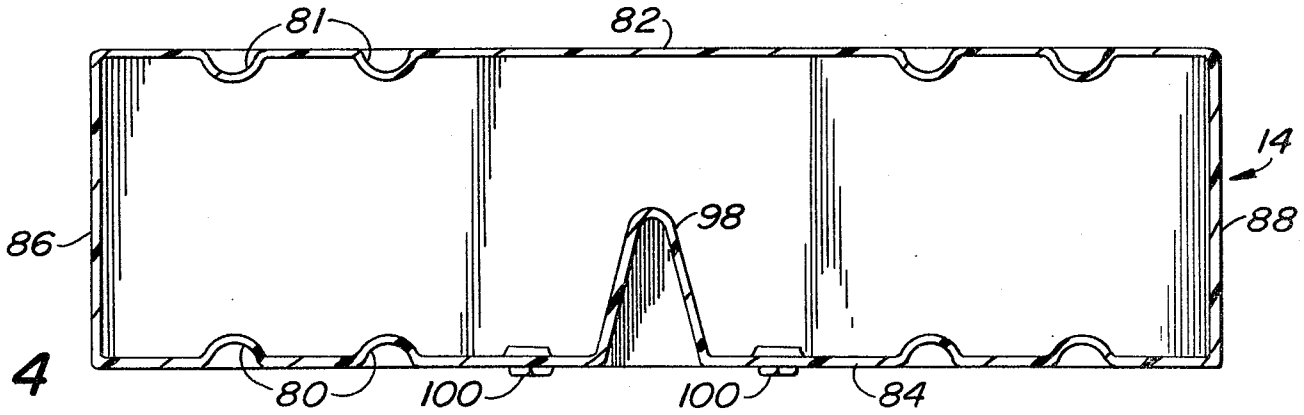
FIG. 4 is a cross-sectional view taken along lines 4—4 of FIG. 3.

As illustrated in FIG. 4, the water tank 14 includes a plurality of strengthening ribs 80, 81 in the form of semi-circular depressions laterally disposed on the top and bottom areas 82 and 84 between the two sides 86 and 88. If let unsupported, the bottom ribs 80 would tend to build up stresses with the areas of the tank adjacent the ribs which could result in damage to the plastic tank. To overcome this problem, as illustrated in FIG. 5, a plurality of semi-circular restrainer strips 90 are disposed to fit into the ribs 80.

In the area where the strip 90 extends over the support channels 56, 58 as illustrated in FIG. 5, a filler material or masonite strip 92 is provided between the strip 90 and the top of the channel 56, illustrated as being a double channel for added strength. The strip 90 may be secured to the channels by means of a countersunk screw 94 held by a nut 96. The strips also provide the primary longitudinal restraint of the water tank.

A central relatively deep indentation or rib 98 is disposed inwardly at the middle of the tank. This provides means for minimizing the forces which are created within the tank by water splashing back and forth as the car changes speeds. Drain ports 100 may be provided in the bottom of the tank.

When the water tank 14 is secured in the support means 10 as illustrated in FIGS. 1, 2 and 3, it is restrained from lateral movement by the vertical portions 50 of the angular members 44 and 46. It is restrained from longitudinal movement (with respect to the length of the car and car movement) by means of the front and rear portions 52, 54 on the angular members 44 and 46.

The restrainer elements 74 provide cushions to absorb small movements of the tank. They also provide means to compensate for small dimensional changes in the water tank as a result of freezing of the water in the tank. The strips 90 provide additional supports when ribs are put in the tank for added strength and also provide the primary longitudinal restraint of the tank.

What is claimed is:

1. A railway car having a plastic water tank mounted therein and support means therefore comprising:

(a) a pair of end brackets secured to the roof of said railway car, (b) a bottom assembly secured to said end brackets for receiving said water tank thereon, said bottom assembly includes a pair of elongated angular members each having a flat horizontal portion to receive said water tank thereon and a flat vertical portion extending from said horizontal portion to receive said water tank therebetween, (c) said bottom assembly including means for restraining the lateral and longitudinal movements of said water tank, and (d) flexible means in engagement with said water tank and roof to compensate for changes in positions or dimensional changes of said water tank.

2. Support means for a plastic water tank as set forth in claim 1 wherein the ends of said angular members each include front and rear portions extending between said horizontal and vertical portions spaced to receive said water tank therebetween.

3. Support means as set forth in claim 2 wherein said bottom assembly further includes a pair of brace channel members connected between said pair of angular members.

4. Support means for a water tank as set forth in claim 3 wherein said pair of channel members are attached to said angular members.

5. Support means for a water tank as set forth in claim 4 wherein said water tank includes a plurality of inwardly extending reinforcing ribs and a plurality of support strips are dimensioned to fit into said ribs of said water tank and to rest on said brace channel members in fixed relationship thereto.

6. Support means for a water tank as set forth in claim 5 wherein said flexible means are provided between said water tank and the roof of said railway car.

7. Support means for a water tank as set forth in claim 6 wherein said flexible means comprises restrainer members disposed at the top front and rear corners of said water tank between said water tank and said roof, said restrainer members including projections extending along the surface of the roof of said railway car.

8. Support means for a water tank as set forth in claim 7 wherein said end brackets each include reinforced front and rear portions connected by cross brace portions.

9. Support means for a water tank as set forth in claim 8 wherein the flat vertical portions of said angular members are positioned to contact the bottom of the sides of said water tank to restrain the lateral movement thereof and said front and rear portions extending between the horizontal and vertical portions of said angular members contact the front and rear bottom corners of said water tank to restrain longitudinal movement thereof, with said strips in said rib also providing longitudinal restraint for said water tank.

* * * * *